US009837224B2

(12) United States Patent
Bausch et al.

(10) Patent No.: US 9,837,224 B2
(45) Date of Patent: Dec. 5, 2017

(54) SWITCHGEAR ASSEMBLY

(71) Applicant: SIEMENS AKTIENGESELLSCHAFT, Munich (DE)

(72) Inventors: Joerg Bausch, Tuchenbach (DE); Michael Heinz, Dresden (DE); Ronald Schmid, Nuremberg (DE)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 340 days.

(21) Appl. No.: 14/404,697

(22) PCT Filed: Apr. 26, 2013

(86) PCT No.: PCT/EP2013/058694
§ 371 (c)(1),
(2) Date: Dec. 1, 2014

(87) PCT Pub. No.: WO2013/178413
PCT Pub. Date: Dec. 5, 2013

(65) Prior Publication Data

US 2015/0145349 A1 May 28, 2015

(30) Foreign Application Priority Data

May 30, 2012 (EP) ..... 12169977

(51) Int. Cl.
*H01H 9/54* (2006.01)
*H01H 9/00* (2006.01)
*H01H 9/30* (2006.01)

(52) U.S. Cl.
CPC ..... *H01H 9/542* (2013.01); *H01H 9/0016* (2013.01); *H01H 9/30* (2013.01); *Y10T 307/918* (2015.04)

(58) Field of Classification Search
CPC ..... H01H 9/542; H01H 9/0016; H01H 9/30; Y10T 307/918
USPC ..... 307/135
See application file for complete search history.

(56) References Cited

U.S. PATENT DOCUMENTS 8,264,102 B2 9/2012 Sadek et al.

FOREIGN PATENT DOCUMENTS

| | | | |
|---|---|---|---|
| CN | 101542886 | A | 9/2009 |
| CN | 201985531 | U | 9/2011 |
| DE | 102008064485 | A1 | 6/2010 |
| DE | 102010023112 | A1 | 12/2011 |
| JP | S5959529 | A | 4/1984 |
| JP | 2000354398 | A | 12/2000 |
| WO | 2010072622 | A1 | 7/2010 |

*Primary Examiner* — Hal Kaplan
(74) *Attorney, Agent, or Firm* — Laurence Greenberg; Werner Stemer; Ralph Locher

(57) ABSTRACT

A load or a generator is connected to an energy line, e.g. a ring feeder of an energy distribution network by using a switching system. For this purpose, the switching system has a thyristor circuit, which is connected in parallel to a disconnect switch and connects the transformer of the switching system to an energy line. Thereby an efficient disconnect switch can be realized, which can be dimensioned depending on the power of the load or generator.

13 Claims, 3 Drawing Sheets

SWITCHGEAR ASSEMBLY

BACKGROUND OF THE INVENTION

Field of the Invention

The invention relates to a switchgear assembly and to a method for operating a switchgear assembly, in particular a ring cable switchgear assembly, by means of which a consumer or a generator is connected to an energy line of an energy distribution system.

FIG. 1 shows a schematic detail of an energy distribution system with a ring circuit. In this case, the electrical energy flow is passed via a ring or a ring cable 102, to which spurs are connected, which are used for further supply and distribution. These spurs are configured as switchgear assemblies. In the arrangement shown in FIG. 1, these switchgear assemblies are referred to as ring cable switchgear assembly 101 or ring main unit. The ring cables 102 are connected to distribution systems 105.

Such ring cable switchgear assemblies 101 usually have three connection points 103, wherein two belong to the ring and one connection point is connected to a consumer or a generator. Embodiments with only two connection points are also known.

As variants, there are also ring cable switchgear assemblies 101 with more than one spur. All of the assemblies have the common factor that at least the spurs have a device 104 which is suitable for interrupting the flowing current. This interruption is usually achieved using circuit breakers or load break switches. In the sector of medium-voltage and high-voltage applications, often complex addons with circuit breakers and switch disconnectors are used in such circuits. In this case, the circuit breaker often represents the largest, heaviest and most complex individual component, in particular when the switchgear assembly is embodied as a gas-insulated switchgear assembly.

This results in complex addons which are sometimes implemented using air-insulated or SF6 gas-insulated technology.

For example, wind turbines are often connected to the energy supply grid via the ring cable switchgear assembly 101. Such a ring cable switchgear assembly 101 is located, for example, at the foot of a tower of the wind turbine. Depending on the voltage level, the circuit and the size of the switchgear assembly, however, an additional building is required for this. Particularly in the case of offshore wind farms and high voltages (33 kV or 66 kV), the space requirement with modern-day technology is enormous; this is also problematic owing to the local conditions.

WO 2010/072622 A1 discloses an on-load tap changer for medium-voltage to low-voltage transformers which is based on one or more mechanical switches. During switchover, the current is passed via semiconductor switches in order to ensure the freedom from interruptions. WO 2010/072622 A1 also does not disclose an efficient possibility for a switch disconnector on the primary side of the transformer.

BRIEF SUMMARY OF THE INVENTION

The object of the invention consists in avoiding the abovementioned disadvantages and in particular in specifying an efficient approach for a ring cable switchgear assembly.

This object is achieved according to the features of the independent claims. Preferred embodiments are set forth in particular in the dependent claims.

In order to achieve the object, a switchgear assembly is proposed which comprises a thyristor circuit, which is arranged in parallel with a switch disconnector, a transformer, whose primary side is connected to an energy line via the parallel circuit comprising the thyristor circuit and the switch disconnector, wherein the secondary side of the transformer is provided for connection of a generator or a consumer.

This makes it possible to achieve efficient electrical disconnection of the generator or consumer from the energy line. The switch disconnector preferably has a certain degree of stability in respect of overvoltages (for example in accordance with the standard IEC62271). For example, the thyristor circuit can be matched flexibly to or designed for a current of up to 4000 A. Thus, the switchgear assembly can be matched in a targeted manner to the power of connected generators, for example wind turbines. This considerably reduces the complexity, the costs, the components required and the required installation space. Precisely for the connection of wind turbines, a switchgear assembly with small dimensions together with the wind turbine (for one or possibly a plurality of wind turbines) can thus be installed in a targeted manner.

In particular, the secondary-side circuit can also comprise at least one switchgear assembly.

A development consists in that the thyristor circuit is embodied with self-shutdown.

Thus, the actuation of the thyristor circuit is simplified.

Another development consists in that the thyristor circuit comprises two thyristor elements connected antiparallel.

Another development consists in that each thyristor element comprises at least one thyristor or at least one parallel and/or series circuit of thyristors.

Other electrical components can also be used jointly with the thyristors.

As an alternative to the thyristors, disconnectable semiconductor switches can also be used, in particular transistors, GTOs (Gate Turn-off Thyristors) or IGCTs (Integrated Gate-Commutated Transistors).

Particularly advantageously, thyristors consisting of superconductive semiconductor material, for example germanium, can also be used. The advantage in this case lies in the low resistance and the higher short-circuit withstand capability.

A development consists in that, in addition to the switch disconnector, a further switch disconnector is arranged in the branch of the thyristor circuit.

A development consists in that the switchgear assembly is a ring cable switchgear assembly and in that the energy line is a ring line of an energy distribution system.

Another development consists in that the switch disconnector is a gas-insulated switch disconnector, a vacuum interrupter or an air-break disconnector.

In particular, a development consists in that the actuation of the switch disconnector and/or the thyristor circuit takes place by means of a control device.

For example, the control device can activate or deactivate the thyristor circuit and/or the switch disconnector. The thyristor circuit can be actuated, for example, via a control current or light pulse firing, such as, for example, using the light of a laser diode.

For example, the control device can comprise a combination of contactors, relays and switching elements, such as rotary switches, or else can be embodied as a digital control unit, for example for remote control via a control center. The control device can be used to automatically disconnect the current in the event of the occurrence of a grid fault, for example a short circuit, or for switching in a targeted manner in order to actively influence the load flow in the ring cable.

Another development consists in that the switchgear assembly is connected to a generator or to a consumer, and wherein the generator or consumer is disconnectable from or connectable to the energy line by means of the switchgear assembly.

In addition, a development consists in that the secondary side of the transformer is connectable to the generator or the consumer via a changeover switch or a multiple changeover switch.

In respect of further details relating to the multiple changeover switch, reference is made to the document WO 2010/072622 A1 cited at the outset.

Within the scope of an additional development, a further thyristor circuit is provided by means of which the changeover switch or a multiple changeover switch is bypassable at least temporarily.

The object mentioned at the outset is also achieved by a method for operating a switchgear assembly, comprising a thyristor circuit, which is arranged in parallel with a switch disconnector, wherein the thyristor circuit and the switch disconnector are connected to the primary side of a transformer via an energy line, in which, prior to the switching operation of the switch disconnector, the thyristor circuit is switched so as to be conducting, in which the switch disconnector is opened, and in which the thyristor circuit is switched so as to be isolating.

In particular, the thyristor circuit is switched on in order to take over the load current during the switchover of the switch disconnector.

A development consists in that, during opening of the switch disconnector, the current is passed completely via the connected thyristor circuit.

One configuration consists in that the current through the switch disconnector and/or through the thyristor circuit is measured.

Based on this measurement, the switch disconnector and/or the thyristor circuit can be actuated correspondingly.

The abovedescribed properties, features and advantages of this invention and the way in which said properties, features and advantages are achieved will become clearer and more easily understandable in connection with the following schematic description of exemplary embodiments, which will be explained in more detail in connection with the drawings. In this case, identical or functionally identical elements can be provided with the same reference symbols for reasons of clarity.

DESCRIPTION OF THE INVENTION

Figure 1:
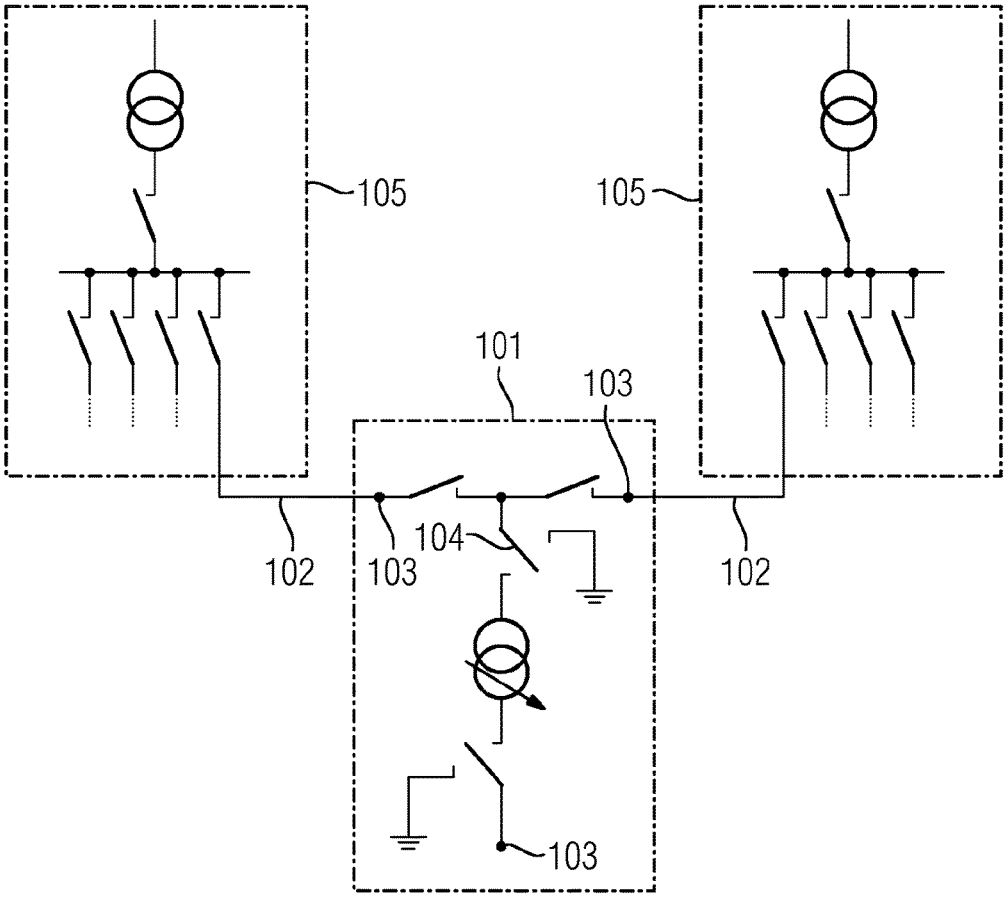
FIG. 1 PRIOR ART
FIG. 1 shows a schematic detail of an energy distribution system with a ring circuit according to the prior art.
Figure 2:
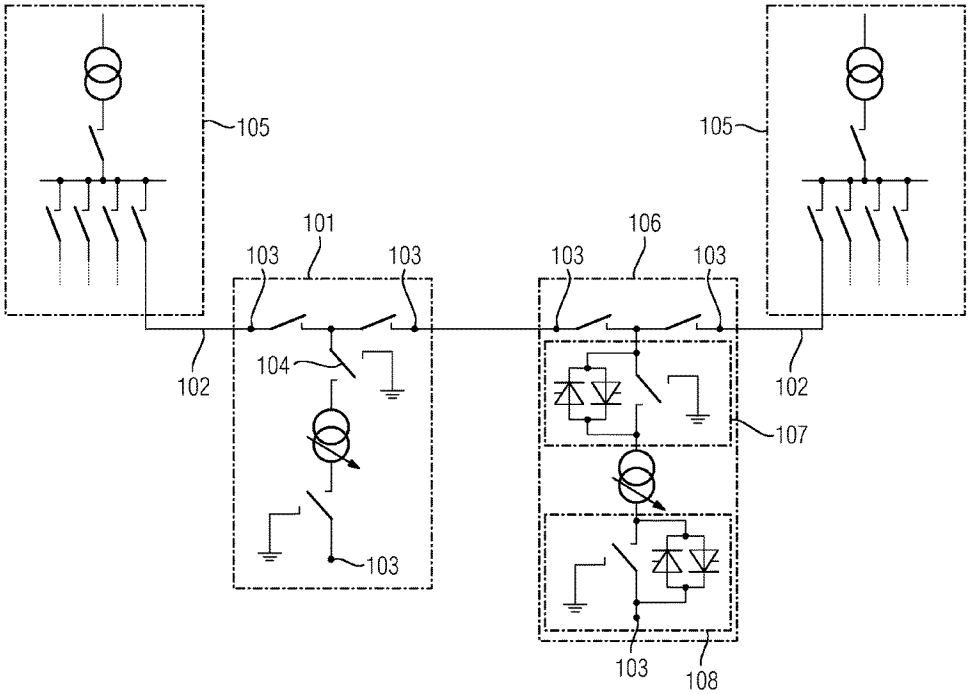
FIG. 2 shows a schematic ring circuit, which, in addition to the illustration in FIG. 1, also has a ring cable switchgear assembly 106, which is configured in an advantageous manner with respect to the ring cable switchgear assembly 101.

FIG. 2 shows a schematic ring circuit which, in addition to the illustration in FIG. 1, also has a ring cable switchgear assembly 106. The ring cable switchgear assembly 106 can in this case be embodied as an alternative to the ring cable switchgear assembly 101. As will be explained in more detail below, the ring cable switchgear assembly 106 has some advantages over the ring cable switchgear assembly 101.

Thus, the interruption 104 (for example the circuit breaker) is simplified, which enables a much more efficient design and use of the ring cable switchgear assembly 106.

Figure 3:
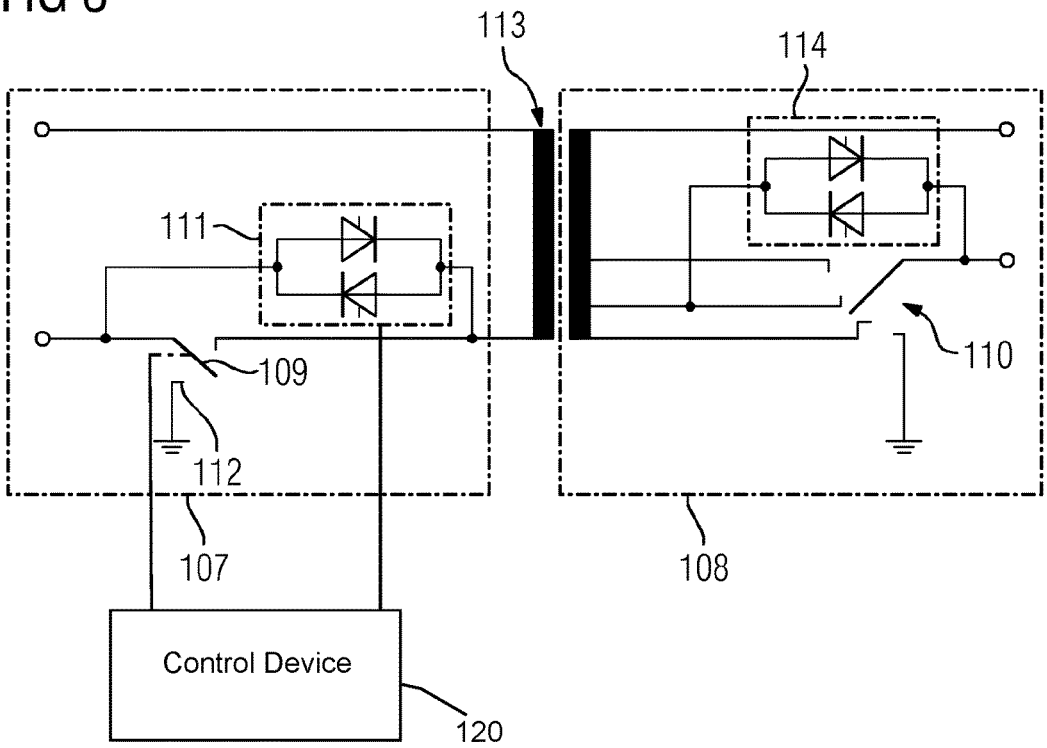
FIG. 3 shows, in supplementary fashion to FIG. 2, a more detailed design of the ring cable switchgear assembly 106.

FIG. 3 shows, by way of supplementing FIG. 2, a more detailed design of the ring cable switchgear assembly 106.

Thus, a switching unit 107 is proposed which has a switch disconnector 109, which enables safe isolation, in combination with a thyristor circuit 111. The switch disconnector is preferably arranged in parallel with the thyristor circuit 111. The switching unit 107 enables effective disconnection of the secondary side from the ring cable 102.

The switch disconnector 109 can be embodied as a simple switch or, as shown in FIG. 3, provided with an additional grounding function 112. In combination with the grounding function 112, the switch disconnector 109 provides the following switching states: on, off and grounded. Preferably, the switch disconnector 109 is embodied as a mechanical switch.

A multiple changeover switch 110, which is arranged in parallel with a thyristor circuit 114, is provided on the secondary side 108 of the transformer 113.

Shortly prior to the switching operation of the switch disconnector 109 or shortly prior to the switching operation of the multiple changeover switch 110, the thyristor circuit 111 is fired at least for the duration of the switching operation of the switch disconnector 109 and thus becomes conducting. After termination of the switching operation of the switch disconnector 109, the thyristor circuit 111 becomes insulating again.

A control device 120 can activate or deactivate the thyristor circuit 111 and/or the switch disconnector 109. For example, the control device 120 can comprise a combination of contactors, relays and switching elements, such as rotary switches, or else can be embodied as a digital control unit, for example for remote control via a control center.

By virtue of the proposed switching unit 107, it is possible to dispense with the circuit breaker or load break switch (cf. device 104 in FIG. 1). It is also possible for a corresponding thyristor circuit 111 to be used in functionally identical fashion as part of the multiple changeover switch of the secondary side 108.

Figure 4:
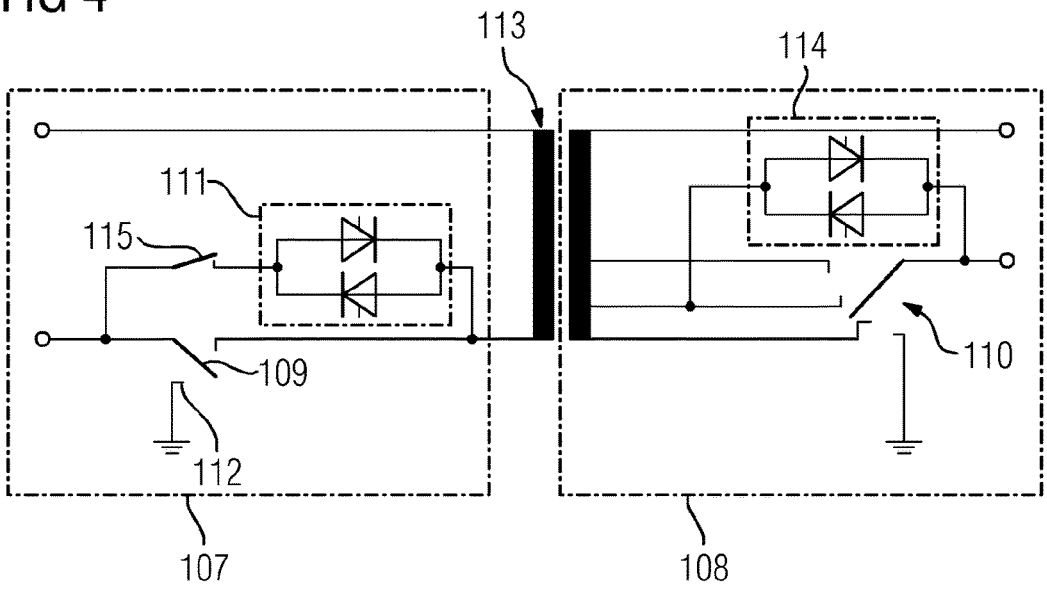
FIG. 4 shows, in supplementary fashion to FIG. 2 and FIG. 3, a design of the ring cable switchgear assembly with an additional switch disconnector in the branch of the thyristor circuit.

FIG. 4 shows, by way of supplementing FIG. 2 and FIG. 3, a design of the ring cable switchgear assembly 106, wherein the switching unit 107 in this case has an additional switch disconnector 115 in the branch of the thyristor circuit 111.

By virtue of the proposed solution, the complexity and number of components required are reduced.

The invention can also advantageously be used when connecting photovoltaic systems to the supply grid. Furthermore, the invention provides an advantage in respect of costs in the case of the high numbers of components to be expected for future SMART grids.

Although the invention has been illustrated and described in detail using the at least one exemplary embodiment shown, the invention is not restricted to this exemplary embodiment and other variants can be derived from this by a person skilled in the art without departing from the scope of protection of the invention.

The invention claimed is:

1. A switchgear assembly, comprising:

a switch disconnector;

a thyristor circuit disposed in parallel with said switch disconnector; and a transformer having a primary side connected to an energy line via a parallel circuit containing said thyristor circuit and said switch disconnector and a secondary side for connection to a generator or a consumer.

2. The switchgear assembly according to claim 1, further comprising a further switch disconnector connected in series with said thyristor circuit.

3. The switchgear assembly according to claim 1, wherein said thyristor circuit contains two thyristor elements connected antiparallel.

4. The switchgear assembly according to claim 3, wherein each of said thyristor elements contains at least one thyristor, at least one parallel circuit of thryristors and/or a series circuit of thyristors.

5. The switchgear assembly according to claim 1, wherein the switchgear assembly is a ring cable switchgear assembly and the energy line is a ring line of an energy distribution system.

6. The switchgear assembly according to claim 1, wherein said switch disconnector is selected from the group consisting of a gas-insulated switch disconnector, a vacuum interrupter and an air-break disconnector.

7. The switchgear assembly according to claim 1, further comprising a control device, wherein an actuation of said switch disconnector and/or said thyristor circuit is performed by said control device.

8. The switchgear assembly according to claim 1, wherein the switchgear assembly is connected to the generator or to the consumer, and the generator or the consumer is disconnectable from or connectable to the energy line by the switchgear assembly.

9. The switchgear assembly according to claim 1, further comprising a switch selected from the group consisting of a changeover switch and a multiple changeover switch, wherein said secondary side of said transformer is connected to the generator or the consumer via said switch.

10. The switchgear assembly according to claim 9, further comprising a further thyristor circuit by which said switch is by-passable at least temporarily.

11. A method for operating switchgear, which comprises the steps of:

providing a switchgear assembly containing a thyristor circuit disposed in parallel with a switch disconnector, wherein the thyristor circuit and the switch disconnector are connected to a primary side of a transformer via an energy line; and switching the thyristor circuit so as to be conducting prior to a switching operation of the switch disconnector in which the switch disconnector is opened, and in which the thyristor circuit is switched so as to be off.

12. The method according to claim 11, which further comprises switching on the thyristor circuit to take over a load current during a switchover of the switch disconnector.

13. The method according to claim 11, which further comprises measuring a current through the switch disconnector and/or through the thyristor circuit.

* * * * *